US008109685B1

(12) United States Patent
Vito

(10) Patent No.: US 8,109,685 B1
(45) Date of Patent: Feb. 7, 2012

(54) LIQUID DISPENSER WITH INTERCHANGEABLE HEAD AND REMOTE OPERATING MECHANISM

(76) Inventor: John Vito, Dalton, PA (US)

( * ) Notice: Subject to any disclaimer, the term of this patent is extended or adjusted under 35 U.S.C. 154(b) by 378 days.

(21) Appl. No.: 12/508,681

(22) Filed: Jul. 24, 2009

Related U.S. Application Data

(63) Continuation-in-part of application No. 12/229,731, filed on Aug. 26, 2008, now abandoned.

(51) Int. Cl.
*A46B 5/02* (2006.01)

(52) U.S. Cl. ..... 401/188 R

(58) Field of Classification Search ..... 401/187, 401/188 R, 136–140
See application file for complete search history.

(56) References Cited

U.S. PATENT DOCUMENTS

| | | | | |
|---|---|---|---|---|
| 622,809 | A | 4/1899 | Keyser | |
| 1,783,506 | A | 11/1929 | Homiller | |
| 3,658,432 | A * | 4/1972 | Lanusse | 401/219 |
| 4,776,716 | A | 10/1988 | Huang | |
| 5,186,392 | A | 2/1993 | Pleshek | |
| 5,364,198 | A | 11/1994 | Skenderi | |
| 6,010,267 | A | 1/2000 | Vito | |
| 6,283,656 | B1 * | 9/2001 | Jiang | 401/1 |
| 6,547,469 | B2 | 4/2003 | Vito | |
| 6,692,171 | B2 | 2/2004 | Vito | |
| 7,832,955 | B1 * | 11/2010 | Leffew et al. | 401/265 |

* cited by examiner

*Primary Examiner* — Huyen Le
(74) *Attorney, Agent, or Firm* — Riddle Patent Law, LLC; Charles L. Riddle

(57) ABSTRACT

A liquid dispenser with an interchangeable head and remote operating mechanism includes: a) an elongated handle member having a proximal end for a user to hold and an opposing distal end, the distal end including a storage compartment; b) a liquid reservoir contained within the storage compartment; c) said liquid reservoir connected to a universal head connector; d) the universal head connector having external exposure at distal end for connection to at least one interchangeable head; e) a pump located in the storage compartment connected to said liquid reservoir; f) remote control means located near the proximal end of the handle member for turning the pump on and off and for operating the pump in a first direction to pump liquid into the liquid supply container and in a second direction for subsequently pumping out of the liquid supply container; and, g) at least one interchangeable head connectable to the universal head connector, selected from the group consisting of a liquid dispensing brush, a liquid dispensing squeegee, a liquid dispensing mop, a paint dispensing head, and combinations thereof.

20 Claims, 7 Drawing Sheets

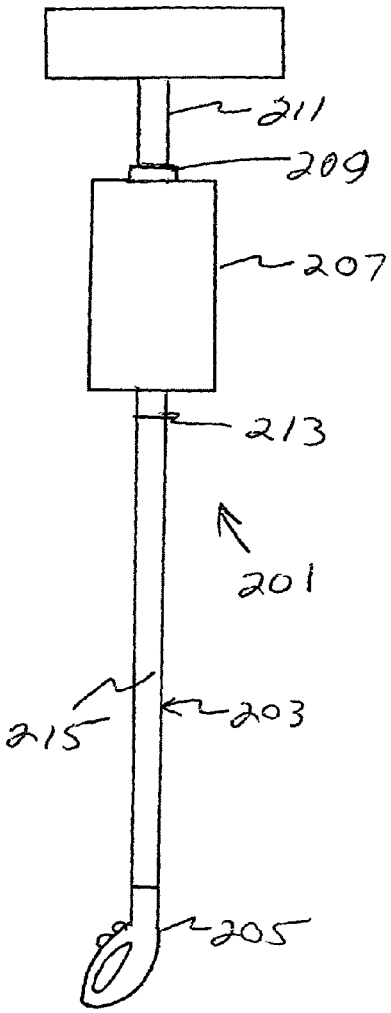
Figure 9
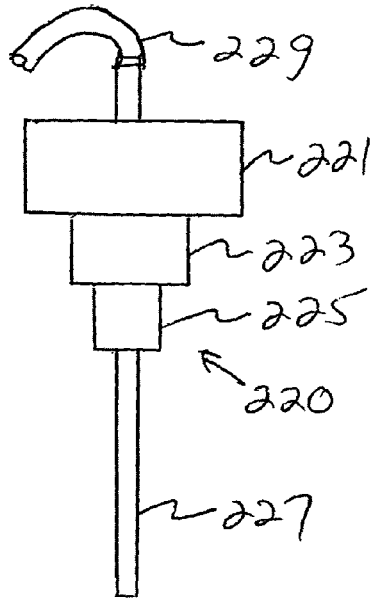
Figure 10
Figure 11
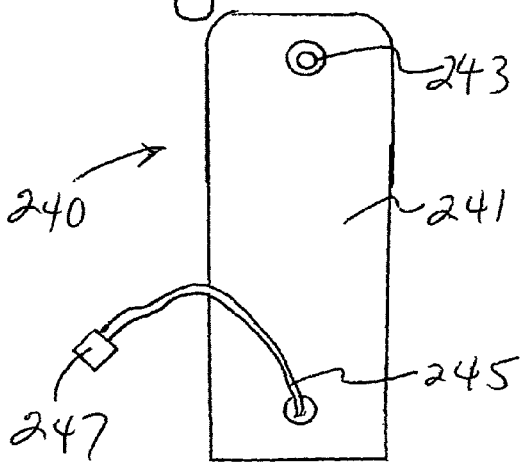

LIQUID DISPENSER WITH INTERCHANGEABLE HEAD AND REMOTE OPERATING MECHANISM

CROSS REFERENCE TO RELATED APPLICATIONS

This application claims priority of incorporates by reference U.S. patent application Ser. No. 12/229,731 filed on Aug. 26, 2008.

BACKGROUND OF INVENTION a. Field of Invention

The invention relates generally to devices for remotely applying a liquid to a surface utilizing a dispenser with a dispenser head at the distal end. The dispenser device has an elongated handle and liquid is delivered to the dispenser head utilizing a remote operating mechanism to activate pump.

b. Description of Related Art

The following patents are representative of the field pertaining to the present invention:

U.S. Pat. No. 6,692,171 B2 to Vito et al. describes a squeegee with squeegee handle and remote spraying device, includes a squeegee section having an enclosed container for holding liquid, a sprayer head, which is in connection with the squeegee section, and a surface extending in a lengthwise direction. The enclosed container has a threaded neck. The sprayer head has a threaded cap adapted for engaging the threaded neck, as well as a dispensing means for dispensing the liquid. The dispensing means includes a trigger being in connection with a conduit, a nozzle at an end of the sprayer head, and pressure inducing means for inducing a pressure change in the conduit so as to draw spraying agent into the conduit and out of the nozzle. The conduit extends through the threaded cap and into the enclosed container. There is also a squeegee blade attached to the sprayer head and being nearly perpendicular to the surface of said enclosed container. In preferred embodiments, an extended handle further includes a plurality of sections in which each section extends to allow for longer reaching range.

U.S. Pat. No. 6,547,469 B2 to Vito describes a spray squeegee having automatic recipient surface wetting mechanism with extension and remote triggering system, which includes a squeegee section having an enclosed container for holding liquid, a sprayer head, which is in connection with the squeegee section, and a surface extending in a lengthwise direction. The enclosed container has a threaded neck. The sprayer head has a threaded cap adapted for engaging the threaded neck, as well as dispensing means for dispensing the liquid. There is a squeegee blade and at least one wiping mechanism. One wiping means includes a wiping support that a plurality of nozzles for wetting the wiping mechanism and is located on a side opposite the blade. Another wiping means, which may be on the blade side or the first wiping mechanism side, is it tillable and includes a clamp for holding a wiping material.

U.S. Pat. No. 6,010,267 to Vito describes an extended squeegee and fluid delivery system for cleaning in places that are of high elevation. A squeegee is used in connection with an extended handle. The spray system has a pump that delivers a cleaning agent through a conduit in connection with the squeegee. There is a trigger in connection with the spray bottle and near the end of the handle where the user is holding the handle. The user may then deliver cleaning agent out the nozzle by squeezing on a trigger or pull cord in connection with the handle. The handle of the squeegee may be made hollow in order to deliver the cleaning agent from the source of the agent to the nozzle in connection with the squeegee.

U.S. Pat. No. 5,364,198 to Skenderi describes a self contained window cleaning implement, the window cleaning implement including an elongated handle member, a squeegee member located on one end of the elongated handle member, a spray nozzle for dispensing a spray, the spray nozzle being located on the one end of the elongated handle member adjacent the squeegee member, the squeegee member extending at an oblique angle outward and downward from the elongated handle member, and the spray apparatus being located above the squeegee member, a reservoir for holding a supply of cleaning fluid, the reservoir being attached to the other end of the elongated handle member opposite the one end of the handle member, a tube extending from the reservoir to the spray nozzle for transferring the cleaning fluid from the reservoir to the spray nozzle, and a manually actuable pump apparatus for forcing the cleaning fluid from the reservoir, through the tube, and to the spray nozzle, the manually actuable pump apparatus being located on the other end of the elongated handle member, and the manually actuable pump apparatus including a digitally depressible trigger member.

U.S. Pat. No. 5,186,392 to Pleshek describes an improvement in an extendable elongate liquid-applying device of the type used for cleaning interior walls and ceilings. The improvement includes first and second tubular members telescoped together and slideable relative to one another to extend and retract the device. One of the members has a proximal end; the other has a distal end and an attached angularly-oriented nozzle. A continuous length of coiled flexible hose extends within the members and connects to the nozzle member. That is, the hose extends unbroken along the lengths of the members, from the proximal end to the distal end, to provide discharge from the nozzle member regardless of the relative positions of the members. A separate base member plugs into the proximal end and has a valve for controlling liquid flow. With a nozzle attached thereto, the base member can be used alone for "close in" cleaning.

U.S. Pat. No. 4,776,716 to Huang describes a foldable multipurpose cleaning device that comprises a fluid-receiving receptacle member detachably connected to a cleaning head assembly. The receptacle member includes a plunger and dispensing means for the fluid. The cleaning head assembly includes an elongated scraper or squeegee and an elongated brush or sponge borne on a carriage member, an intermediate coupling member projecting from the carriage member and comprising a female housing member with a locking notch in its base, a slotted body member topped with a male head portion that has near its base a lug that is engagable with the notch on the female housing member in a releasable gripping relationship when the carriage member is in a generally horizontal position for operation, the female housing member being pivotally attached to the male head portion by means of oppositely-disposed pivot pin elements projecting from the male head portion into corresponding pivot slots in the female housing member for slip joint action therebetween.

U.S. Pat. No. 1,783,506 to T. C. Homiller describes in a cleaning device of the described, an apertured delivering and distributing head, and a hollow elongated handle carried by said head, said handle being a water container communicating with said head having a force feed means including an air passage incorporated in its lower end to eject the water, a regulating valve in said head, and an operating lever on said handle and an operating connection between said lever and valve.

U.S. Pat. No. 622,809 to C. R. Keyser describes the combination of the handle, the metallic ball or sphere mounted on the top thereof, the tank above and communicating "therewith, the spout projecting from the tank into the metallic ball, the rubber ball within the metallic ball, embracing the spout, the discharge-tube passing through the tank and spout into the rubber ball, and the pivoted crossed levers, bearing upon the sides of the rubber ball, substantially as described.

Notwithstanding the prior art, the present invention is neither taught nor rendered obvious thereby.

SUMMARY OF INVENTION

A present invention liquid dispenser with an interchangeable head and remote operating mechanism includes: a) an elongated handle member having a proximal end for a user to hold and an opposing distal end, the distal end including a storage compartment; b) a liquid reservoir contained within the storage compartment; c) fluid conduit connected at a first end to the liquid reservoir and connected at a second end to a universal head connector; d) the universal head connector located at second end of the fluid conduit and having external exposure at distal end for connection to at least one interchangeable head; e) a pump located in the storage compartment and functionally connected to the fluid conduit; f) remote control means located near the proximal end of the handle member for turning the pump on and off and for operating the pump in a first direction to pump liquid into the liquid supply container and in a second direction for subsequently pumping out of the liquid supply container; and, g) at least one interchangeable head connectable to the universal head connector, selected from the group consisting of a liquid dispensing brush, a liquid dispensing squeegee, a liquid dispensing mop, a paint dispensing head, and combinations thereof.

In some preferred embodiments of the present invention liquid dispenser with interchangeable head and remote operating mechanism, the elongated handle member is a telescopic handle member.

In some preferred embodiments of the present invention liquid dispenser with interchangeable head and remote operating mechanism, the storage compartment further includes a reversible electric motor connected to the pump.

In some preferred embodiments of the present invention liquid dispenser with interchangeable head and remote operating mechanism, the remote control means is connected by wire connection to the electric motor.

In some preferred embodiments of the present invention liquid dispenser with interchangeable head and remote operating mechanism, the remote control means is connected by wireless connection to the electric motor.

In some preferred embodiments of the present invention liquid dispenser with interchangeable head and remote operating mechanism, the electric motor is a battery operated electric motor and the storage compartment includes battery holding means and connection means to at least one of the electric motor, and the remote control means.

In some preferred embodiments of the present invention liquid dispenser with interchangeable head and remote operating mechanism, the at least one interchangeable head is a liquid dispensing mop with a pad.

In some preferred embodiments of the present invention liquid dispenser with interchangeable head and remote operating mechanism, the at least one interchangeable head is a paint dispensing head selected from the group consisting of a paint dispensing pad, a paint dispensing brush and a paint dispensing roller.

In some preferred embodiments of the present invention liquid dispenser with interchangeable head and remote operating mechanism, the at least one interchangeable head is a head with a squeegee.

In some preferred embodiments of the present invention liquid dispenser with interchangeable head and remote operating mechanism, the remote control means includes at least one forward pumping control button to dispense liquid from the liquid reservoir and at least one reverse pumping control button to feed liquid into the liquid reservoir.

In another embodiment of the present invention, a liquid dispenser with an interchangeable head and remote operating mechanism which includes: a) an elongated handle member having a proximal end for a user to hold and an opposing distal end, the distal end included a storage compartment; b) a liquid reservoir contained within the storage compartment; c) fluid conduit connected at a first end to the liquid reservoir and connected at a second end to a universal head connector; d) a side inlet member located within the storage compartment and connected at one end to one of the fluid conduit and the liquid reservoir and at an opposite end to an external area of the storage compartment, the side inlet member having a one way valve to permit liquid to flow into the reservoir and to prevent liquid from flowing out of the side inlet member to provide a fill inlet separate from the universal head connector; and, e) the universal head connector located at second end of the fluid conduit and having external exposure at distal end for connection to at least one interchangeable head; f) a pump located in the storage compartment and functionally connected to the fluid conduit; g) remote control means located near the proximal end of the handle member for turning the pump on and off and for operating the pump in a first direction to pump liquid into the liquid supply container and in a second direction for subsequently pumping out of the liquid supply container; and, h) at least one interchangeable head connectable to the universal head connector, selected from the group consisting of a liquid dispensing brush, a liquid dispensing squeegee, a liquid dispensing mop, a paint dispensing head and combinations thereof.

In some preferred embodiments of the present invention liquid dispenser with interchangeable head and remote operating mechanism described by the paragraph above, the elongated handle member is a telescopic handle member.

In some preferred embodiments of the present invention liquid dispenser with interchangeable head and remote operating mechanism described by the paragraph above, storage compartment further includes a reversible electric motor connected to the pump. Or, alternately, a second pump operatively coupled is used to pump an a reverse direction.

In some preferred embodiments of the present invention liquid dispenser with interchangeable head and remote operating mechanism described by the paragraph above, the remote control means is connected by wire connection to the electric motor.

In some preferred embodiments of the present invention liquid dispenser with interchangeable head and remote operating mechanism described by the paragraph above, the remote control means is connected by wireless connection to the electric motor.

In some preferred embodiments of the present invention liquid dispenser with interchangeable head and remote operating mechanism described by the paragraph above, the electric motor is a battery operated electric motor and the storage compartment includes battery holding means and connection means to at least one of the electric motor, and the remote control means.

In some preferred embodiments of the present invention liquid dispenser with interchangeable head and remote operating mechanism described by the paragraph above, the at least one interchangeable head is a liquid dispensing mop with a pad.

In some preferred embodiments of the present invention liquid dispenser with interchangeable head and remote operating mechanism described by the paragraph above, the at least one interchangeable head is a paint dispensing head selected from the group consisting of a paint dispensing pad, a paint dispensing brush and a paint dispensing roller.

In some preferred embodiments of the present invention liquid dispenser with interchangeable head and remote operating mechanism described by the paragraph above, the at least one interchangeable head is a head with a squeegee.

In some preferred embodiments of the present invention liquid dispenser with interchangeable head and remote operating mechanism described by the paragraph above, the remote control means includes at least one forward pumping control button to dispense liquid from the liquid reservoir and at least one reverse pumping control button to feed liquid into the liquid reservoir. As discussed herein, the pump may include any pump capable of delivering fluid, preferably the pump is a positive displacement pump capable of bi-directional pumping. Examples include rotary lobe pump, progressing cavity pump, rotary gear pump, piston pump, plunger pump, diaphragm pump, screw pump, gear pump, vane pump, regenerative (peripheral) pump, and, preferably, a peristaltic pump. As discussed herein, the liquid reservoir may include any containment capable of holding a fluid and allowing the fluid to be delivered to the interchangeable head via the pump. Examples include a rigid container with a valve, a semi rigid container, a collapsible container, a bag, a collapsible bag, a bladder, or anything of the like. As discussed herein, the fluid conduit is any object for allowing fluid to flow from the liquid reservoir to the pump, to the head. Examples include fluid couplers, snap on fluid couplers, plastic tube, rigid tubes, and, preferably, flexible tubing if used with a peristaltic pump.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings:

FIG. 9 is a front view of another embodiment of a present invention liquid dispenser with interchangeable head and operating mechanism, illustrating a segmented handle member;

FIG. 10 is a front view of a universal stopper unit for fitting into different diameter containers; and, FIG. 11 is a front view of a camelback bag unit for transferring liquid of a present invention liquid dispenser with interchangeable head and operating mechanism, wherein the camelback bag unit is a collapsible liquid reservoir.

DETAILED DESCRIPTION OF THE EMBODIMENTS

The invention relates generally to invention liquid dispenser with interchangeable head and operating mechanism for remotely applying a liquid to a surface utilizing a dispenser with a dispenser head at the distal end. The dispenser device has an elongated handle and liquid is delivered to the dispenser head utilizing a remote operating mechanism to activate pump.

The dispensing head may be a mop pad head, a liquid dispensing unit, a liquid dispensing squeegee, a liquid dispensing mop unit, a paint roller unit, a paint pad unit, a brush unit, or combinations thereof. The dispensing head includes a liquid dispensing manifold.

The device includes an elongated handle in which the handle may be one piece, telescoping, or separate sections that are removable. When there are separate removable sections, the sections have a male connection at a top end and a female connection at a bottom end of each section.

The pumping mechanism operates under at least one pump which is under processor control. There is a mechanism for activating the pump including on/off, forward liquid movement into the dispensing head and reverse liquid movement into the liquid reservoir. A transmitter and receiver control movement of the pump motor.

Figure 1:
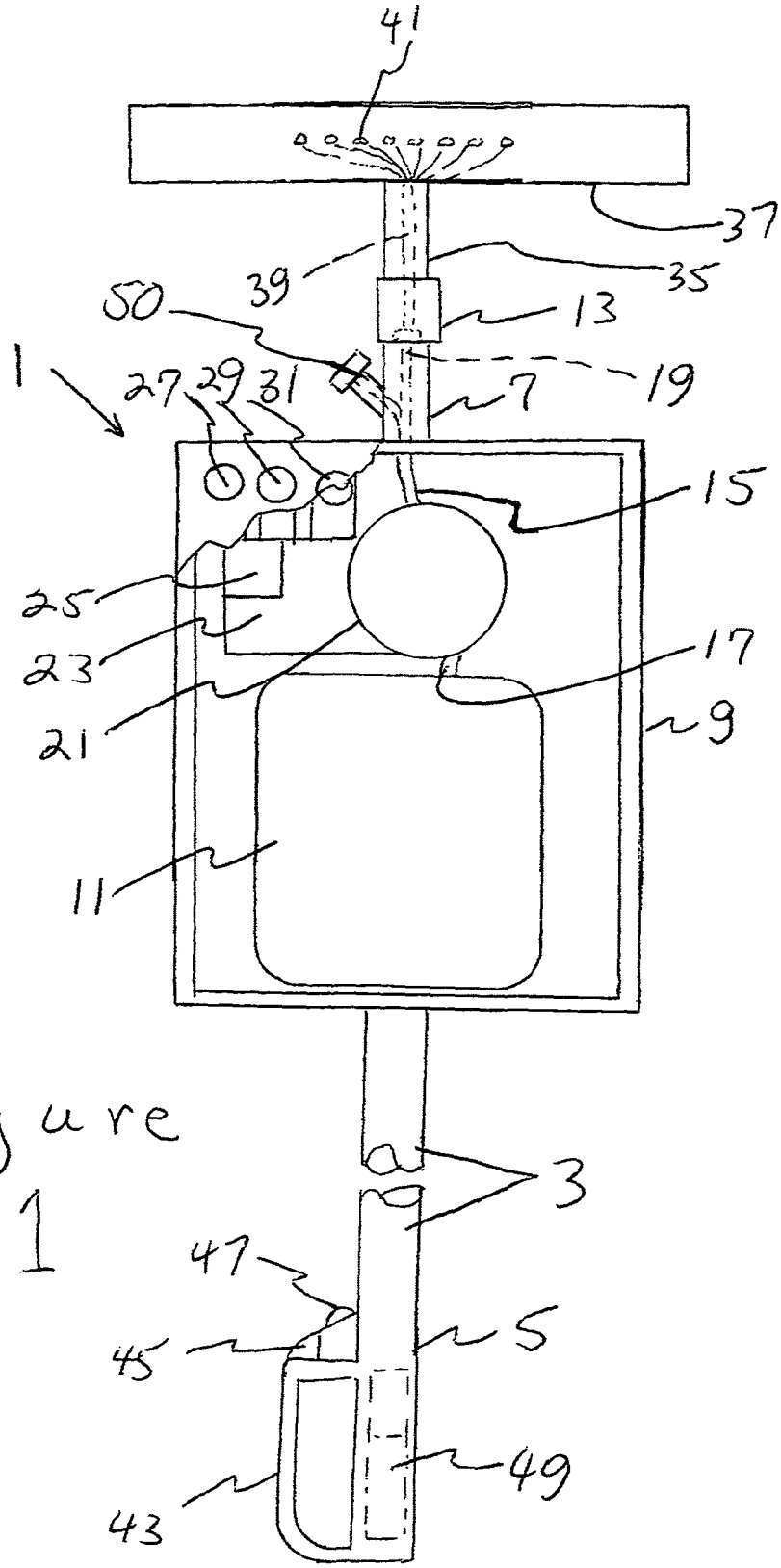
FIG. 1 is a back partially cut view of an embodiment of a present invention liquid dispenser with interchangeable head and operating mechanism.

Referring now in detail to the drawings wherein like reference numerals designate corresponding parts throughout the several views, various embodiments of the present invention are shown. FIG. 1 is a back partially cut view of an embodiment of a present invention liquid dispenser with interchangeable head and operating mechanism 1.

The liquid dispenser with an interchangeable head and remote operating mechanism 1 includes an elongated handle member 3, a liquid reservoir 11, fluid conduit 15, a universal head connector 13, a pump 21, at least one remote control means 45,47 and at least one interchangeable head 37, in this case a mop head. The elongated handle member 3 has a proximal end 5 with a handle 43 for a user to hold, and an opposing distal end 7. The distal end 7 includes a storage compartment 9.

The elongated handle member 3 may be a telescopic handle member, separate sections, or one piece. The elongated handle member 3 may be six inches to one foot, but is preferably at least three feet. However, it may be eight or ten feet. The liquid reservoir 11 is contained within the storage compartment 9.

The fluid conduit 15 is connected at a first end 17 to the liquid reservoir 11 and connected at a second end 19 to a universal head connector 13. The universal head connector 13 is located at the second end 19 of the fluid conduit 15 and has external exposure at the distal end for connection to at least one interchangeable head 37. The at least one interchangeable head 37 is connectable to the universal head connector 13. In this case the interchangeable head is a mop pad head, but it may be a liquid dispensing unit, a liquid dispensing squeegee, a liquid dispensing mop unit, a paint roller unit, a paint pad unit, a brush unit, or combinations thereof. The mop pad head includes a liquid dispensing manifold 41 and a rigid head tube 35 connected to the mop head member at one end and connected to the universal head connector at the other end. The connections are made through threading. The mop rigid head tube 35 includes a fluid conduit inside the rigid head tube. The liquid dispensing manifold 41 includes at least one aperture for dispensing the liquid.

The pump 21 is located in the storage compartment 9 and is functionally connected to the fluid conduit 15. The pump 21 includes a motor, power source and controller, collectively shown as unit 23. In addition, a remote control wireless receiver 25 is functionally connected to the motor, power source and controller, collectively shown as unit 23. The motor may be a battery operated electric motor, in which case, the storage compartment includes battery holding means and connection means to at least one of the electric motor 23, and the remote control means 45, 47. The remote control means 45, 47 may be connected by wire connection or by wireless connection to the electric motor 23 through a motor, power source transmitter and power source, collectively shown as unit 49.

The remote control means 45,47 is located near the proximal end 5 of the elongated handle member 3. Remote control means 45 is a directional switch for forward and reverse pumping for operating the pump in a first direction to pump liquid into the liquid reservoir 11 and in a second direction for subsequently pumping out of the liquid reservoir 11.

There are optional manual overrides for a forward pump button 27, a reverse pump button 29, and an on/off button 31. When the elongated handle member 3 is eight feet long, for example, it would be easier to use the manual override buttons.

There is an inlet valve 50 including a one-way valve for refilling the liquid reservoir 11. The inlet valve 50 extends into the fluid conduit 15 which exits into the liquid reservoir 11. The inlet valve 50 is located within the storage compartment 9 and is connected at one end to one of the fluid conduit 15 and the liquid reservoir 11. The inlet valve 50 is connected at an opposite end to an external area of the storage compartment 9. Furthermore, the inlet one-way valve permits liquid to flow into the reservoir 11 and prevents liquid from flowing out of the inlet valve 50 to provide a fill inlet separate from the universal head connector 13.

In operation, the liquid reservoir 11 is first filled with liquid and the handle member is extended or shortened, if it is not a single segment. The power button 47 is turned on and the directional switch 45 for dispensing is held down to remotely operate the pump in a forward direction. Forward pumping out of the liquid reservoir is selected. The transmitter 49 sends signals to the remote control wireless receiver 25 to operate the pump 21 via unit 23. The pump 21 pumps liquid out of the liquid reservoir 11 through the fluid conduit 15 which flows into the fluid conduit 39 and out through the liquid dispensing manifold 41. The liquid being dispensed may be a cleaner, water, paint or any other liquid and mop pad head 37 could be any of the appropriate interchangeable heads described above and below.

When a user needs to stop the flow of liquid out of the liquid reservoir, the power button 47 is moved to off. Through the transmitter and the receiver, the flow of the liquid is stopped. When a user needs to move liquid into the liquid reservoir 11, the directional switch (not shown because it is behind forward directional switch 45 show in the Figure) is pressed to reverse flow of liquid into the liquid reservoir 11. Of course, the optional manual override buttons may also be employed to perform the operational functions.

There are many ways for filling the liquid reservoir 11. A hose and gravity feed may be employed by using inlet valve 50. Other means for filling the liquid reservoir include the use of an external pump, prefilled liquid resevoirs that are inserted through an opening in the storage compartment having fastening means, inserting a universal stopper into the liquid reservoir connected to a liquid source and activating reverse flow of liquid, filling a camelback bag unit or any other means for moving liquid from one source to another or collecting liquid in a liquid reservoir.

Figure 2A:
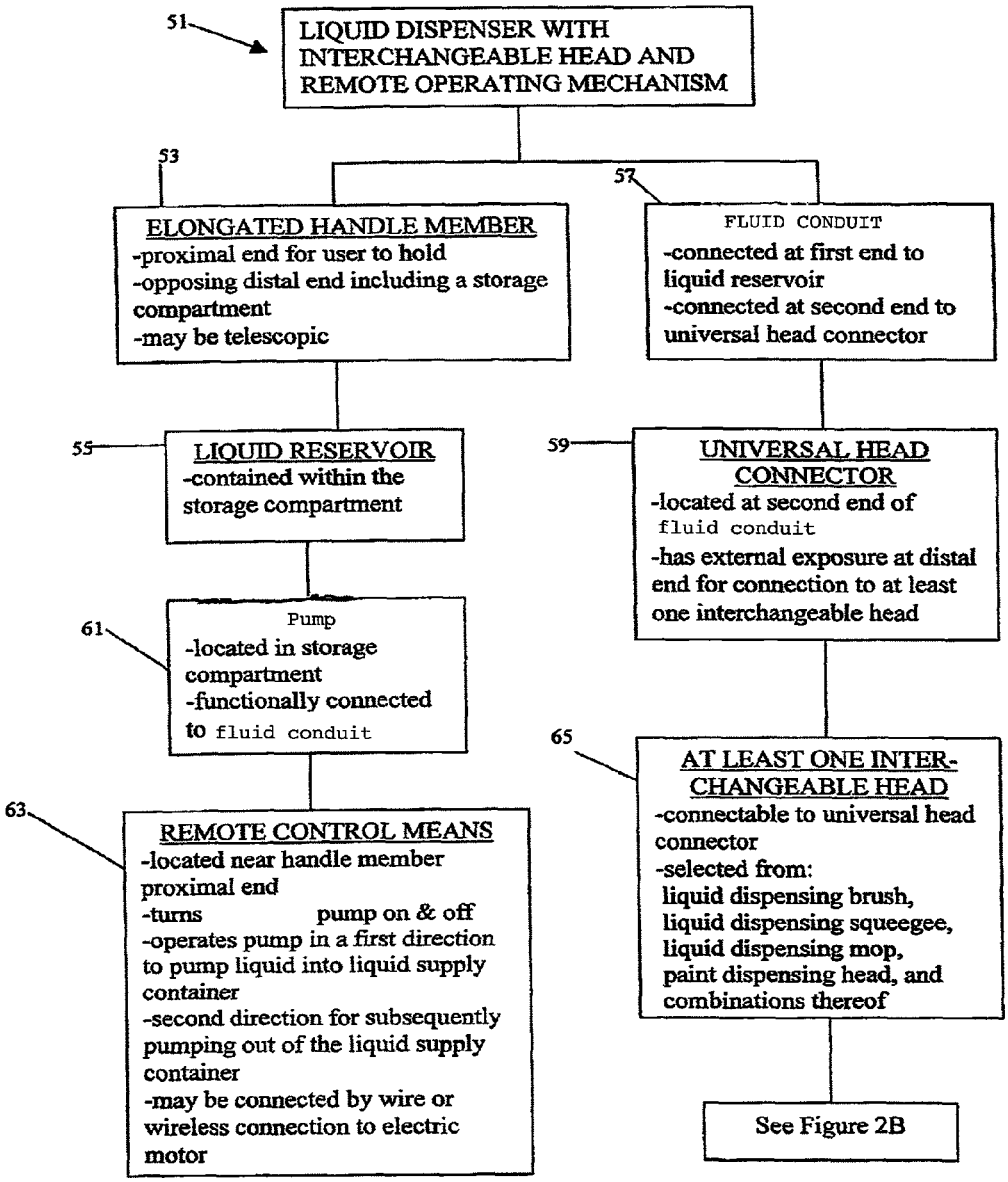
FIGS. 2A and 2B are a schematic diagram of an embodiment of a present invention liquid dispenser with interchangeable head and operating mechanism.
Figure 2B:
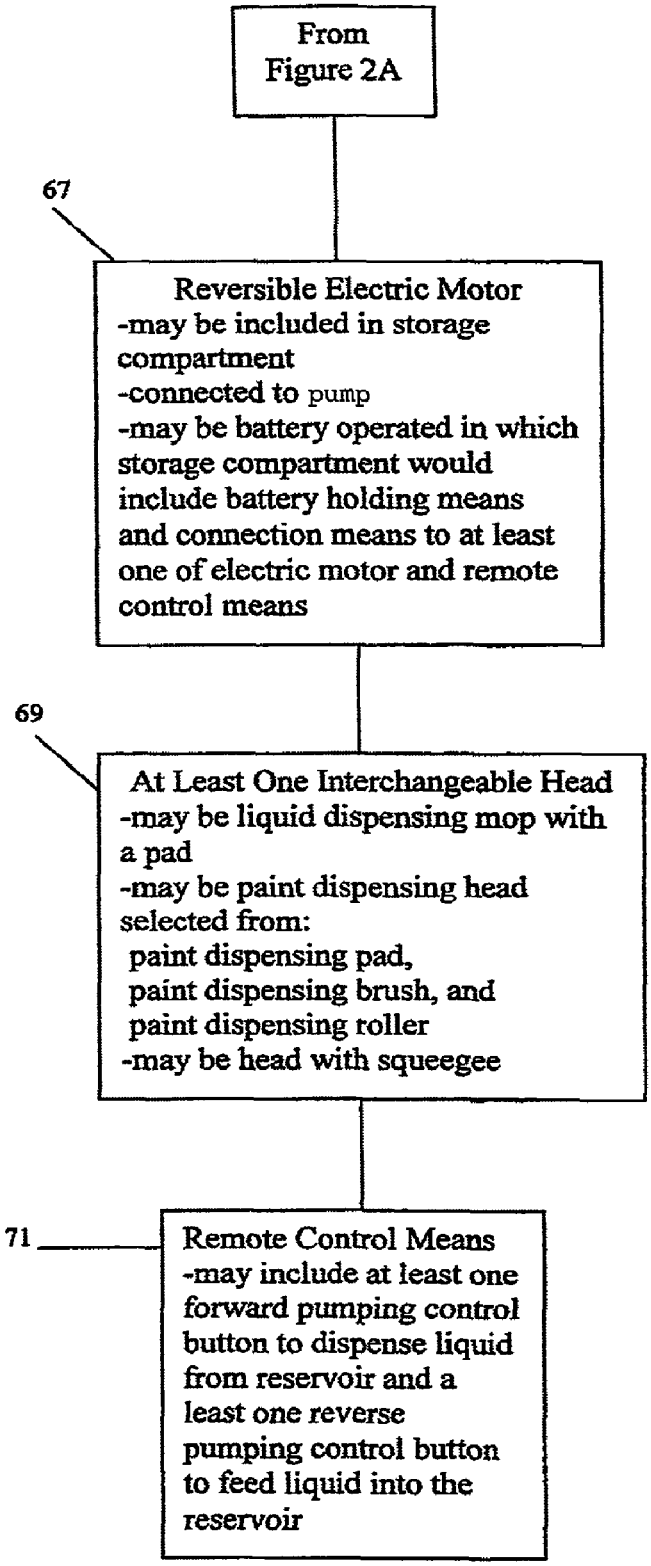

FIGS. 2A and 2B are a schematic diagram of an embodiment of a present invention liquid dispenser with interchangeable head and operating mechanism. A liquid dispenser with an interchangeable head and remote operating mechanism 51 includes an elongated handle member 53, a liquid reservoir 55, fluid conduit 57, a universal head connector 59, a pump 61, at least one remote control means 63 and at least one interchangeable head 65. With reference to box 53, the elongated handle member has a proximal end for a user to hold and an opposing distal end. The distal end includes a storage compartment. The elongated handle member may be a telescopic handle member. With reference to box 55, the liquid reservoir is contained within the storage compartment. With reference to box 57, the fluid conduit is connected at a first end to the liquid reservoir and connected at a second end to a universal head connector. With reference to box 59, the universal head connector is located at the second end of the fluid conduit and has external exposure at distal end for connection to at least one interchangeable head. With reference to box 61, the pump is located in the storage compartment and is functionally connected to the fluid conduit.

With reference to box 63, the remote control means is located near the proximal end of the handle member for turning the pump on and off. Furthermore, the remote control means is and for operating the pump in a first direction to pump liquid into the liquid supply container and in a second direction for subsequently pumping out of the liquid supply container.

With reference to box 65, the at least one interchangeable head is connectable to the universal head connector. It may be a liquid dispensing brush, a liquid dispensing squeegee, a liquid dispensing mop, a paint dispensing head, or combinations thereof.

The liquid dispenser with interchangeable head and remote operating mechanism with reference to box 67, the storage compartment further includes a reversible electric motor connected to the pump. The electric motor may be a battery operated electric motor, in which case, the storage compartment includes battery holding means and connection means to at least one of the electric motor, and the remote control means. Referring again to box 63, the remote control means may be connected by wire connection or by wireless connection to the electric motor.

With reference to box 69, the at least one interchangeable head may be a liquid dispensing mop with a pad. Alternatively, the at least one interchangeable head may be a paint dispensing head selected from a paint dispensing pad, a paint dispensing brush and a paint dispensing roller. Furthermore, the at least one interchangeable head may be a head with a squeegee.

With reference to box 71, the remote control means may include at least one forward pumping control button to dispense liquid from the liquid reservoir and at least one reverse pumping control button to feed liquid into the liquid reservoir.

Figure 3A:
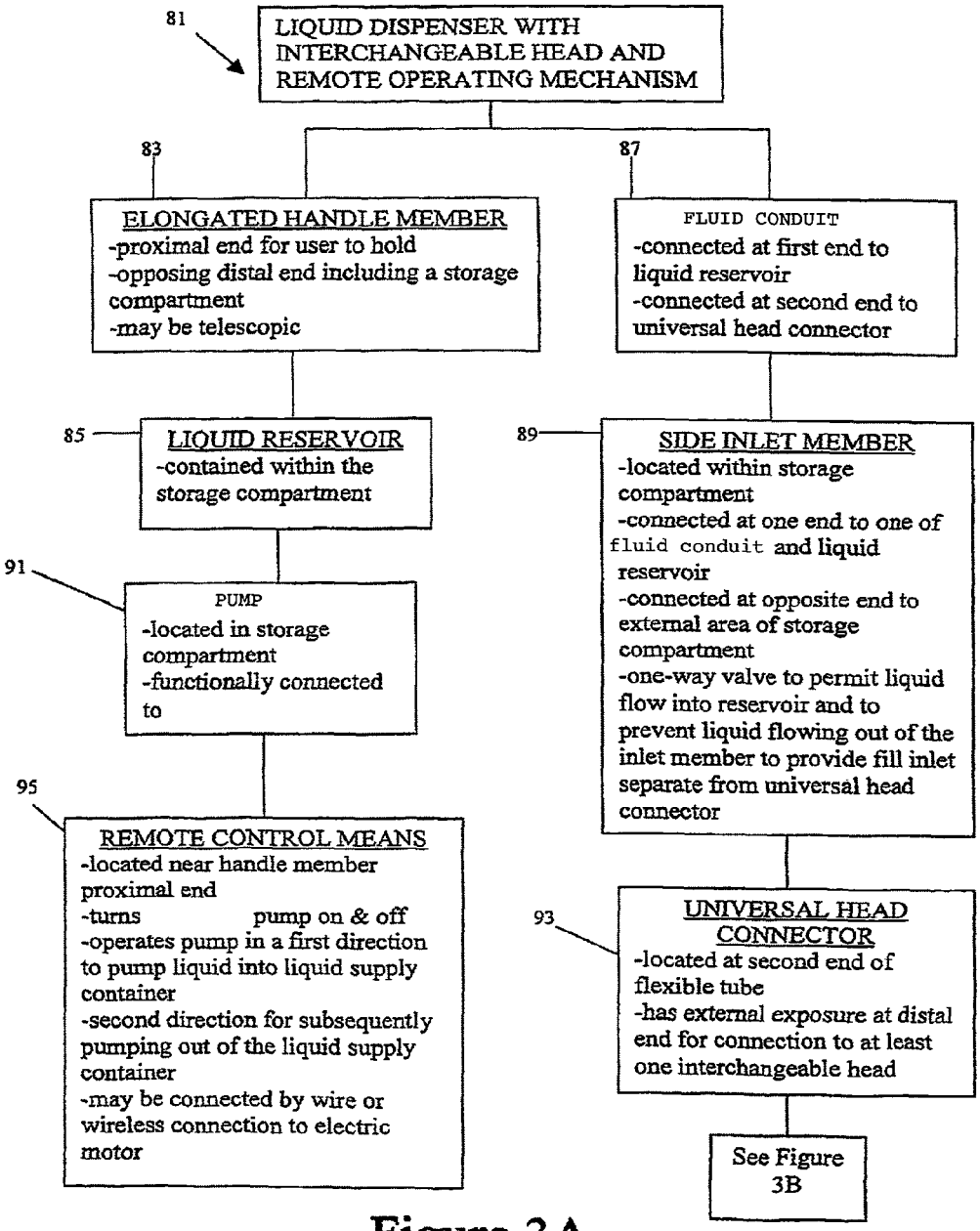
FIGS. 3A and 3B are a schematic diagram of another embodiment of a present invention liquid dispenser with interchangeable head and operating mechanism.
Figure 3B:
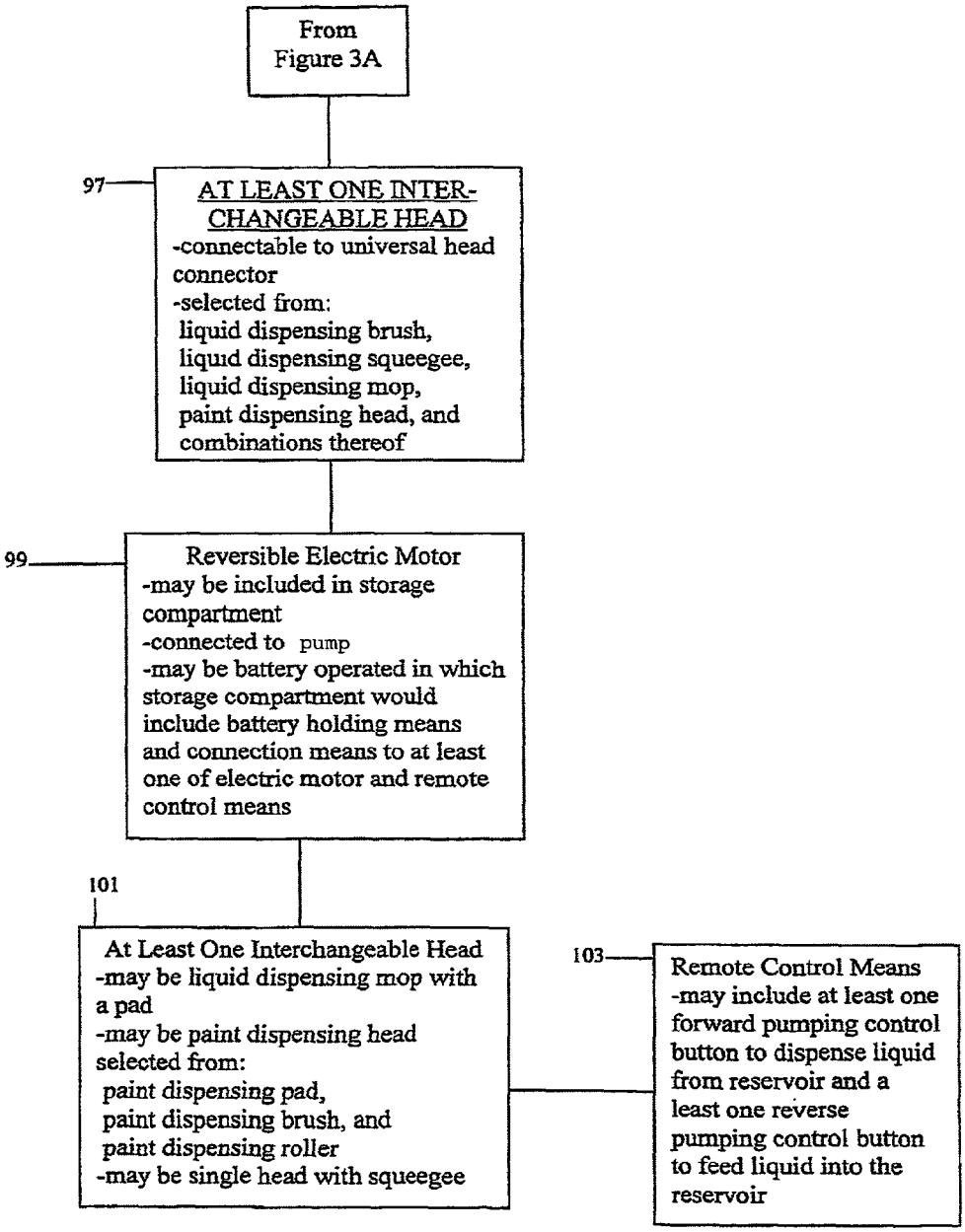

FIGS. 3A and 3B are a schematic diagram of another embodiment of a present invention liquid dispenser with interchangeable head and operating mechanism;

A liquid dispenser with an interchangeable head and remote operating mechanism 81 includes an elongated handle member 83, a liquid reservoir 85, fluid conduit 87, a side inlet member 89, a universal head connector 93, a pump 91, at least one remote control means 95 and at least one interchangeable head 97. With reference to box 83, the elongated handle member has a proximal end for a user to hold and an opposing distal end. The distal end includes a storage compartment. The elongated handle member may be a telescopic handle member. With reference to box 85, the liquid reservoir is contained within the storage compartment. With reference to box 87, the fluid conduit is connected at a first end to the liquid reservoir and connected at a second end to a universal head connector. With reference to box 93, the universal head connector is located at the second end of the fluid conduit and has external exposure at distal end for connection to at least one interchangeable head. With reference to box 91, the pump is located in the storage compartment and is functionally connected to the fluid conduit.

With reference to box 89, the side inlet member is located within the storage compartment and connected at one end to one of the fluid conduit and the liquid reservoir. The side inlet member is connected at an opposite end to an external area of the storage compartment. Furthermore, the side inlet member has a one-way valve to permit liquid to flow into the reservoir and to prevent liquid from flowing out of the side inlet member to provide a fill inlet separate from the universal head connector.

With reference to box 95, the remote control means is located near the proximal end of the handle member for turning the pump on and off. Furthermore, the remote control means is and for operating the pump in a first direction to pump liquid into the liquid supply container and in a second direction for subsequently pumping out of the liquid supply container. As discussed herein, this is accomplished using a bi-directional pump, one or more additional pumps, or appropriate actuation of valves connected to the fluid conduit.

With reference to box 97, the at least one interchangeable head is connectable to the universal head connector. It may be a liquid dispensing brush, a liquid dispensing squeegee, a liquid dispensing mop, a paint dispensing head, or combinations thereof.

With reference to box 99, the storage compartment further includes a reversible electric motor connected to the pump. The electric motor may be a battery operated electric motor, in which case, the storage compartment includes battery holding means and connection means to at least one of the electric motor, and the remote control means. Alternately, a bi-directional pump, one or more additional pumps, or appropriate actuation of valves connected to the fluid conduit are used to achieve reverse flow. Referring again to box 95, the remote control means may be connected by wire connection or by wireless connection to the electric motor.

With reference to box 101, the at least one interchangeable head may be a liquid dispensing mop with a pad. Alternatively, the at least one interchangeable head may be a paint dispensing head selected from a paint dispensing pad, a paint dispensing brush and a paint dispensing roller. Furthermore, the at least one interchangeable head may be a head with a squeegee.

With reference to box 103, the remote control means may include at least one forward pumping control button to dispense liquid from the liquid reservoir and at least one reverse pumping control button to feed liquid into the liquid reservoir.

Figure 4:
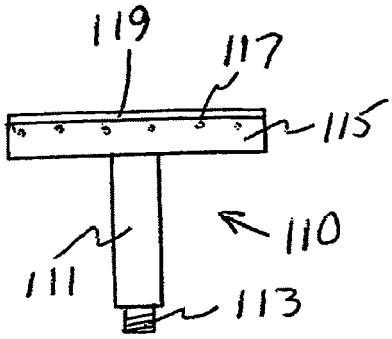
FIG. 4 is a back view of an embodiment of a present invention interchangeable liquid dispenser with interchangeable head and operating mechanism, illustrating an interchangeable squeegee head unit.

FIG. 4 is a back view of an embodiment of a present invention interchangeable liquid dispenser with interchangeable head and operating mechanism, illustrating an interchangeable squeegee head unit 110. The interchangeable squeegee head unit 110 includes a rigid head tube 111 with hosing inside with a threaded end 113 for connection to a universal head connector. In addition, there is a spray manifold housing and squeegee support, collectively shown as unit 115, at least one spray manifold port 117, and a squeegee 119.

Figure 5:
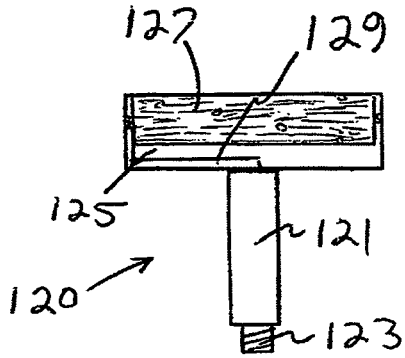
FIG. 5 is a back view of an embodiment of a present invention interchangeable liquid dispenser with interchangeable head and operating mechanism, illustrating an interchangeable paint roller head unit.

FIG. 5 is a back view of an embodiment of a present invention interchangeable liquid dispenser with interchangeable head and operating mechanism, illustrating an interchangeable paint roller head unit 120. The interchangeable paint roller head unit 120 includes a rigid head tube 121 with hosing inside with a threaded end 123 for connection to a universal head connector. In addition, there is a roller support 125, a roller with at least one paint release port 127, and a paint feed line 129.

Figure 6:
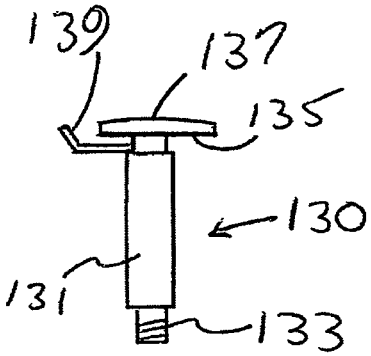
FIG. 6 is a back view of an embodiment of a present invention interchangeable liquid dispenser with interchangeable head and operating mechanism, illustrating an interchangeable mop pad head unit.

FIG. 6 is a back view of an embodiment of a present invention interchangeable liquid dispenser with interchangeable head and operating mechanism, illustrating an interchangeable mop pad head unit 130. The interchangeable mop pad head unit 130 includes a rigid head tube 131 with hosing inside with a threaded end 133 for connection to a universal head connector. In addition, there is a mop pad support 135, a mop pad 137, and a spray nozzle 139.

Figure 7:
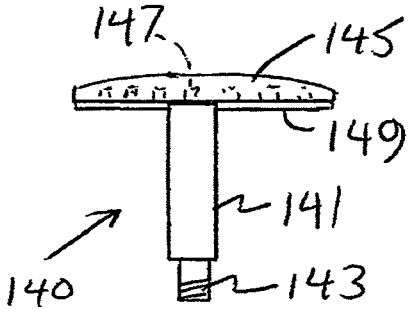
FIG. 7 is a back view of an embodiment of a present invention interchangeable liquid dispenser with interchangeable head and operating mechanism, illustrating an interchangeable paint pad head unit.

FIG. 7 is a back view of an embodiment of a present invention interchangeable liquid dispenser with interchangeable head and operating mechanism, illustrating an interchangeable paint pad head unit 140. The interchangeable paint pad head unit 140 includes a rigid head tube 141 with hosing inside with a threaded end 143 for connection to a universal head connector. In addition, there is a paint pad support 145, a paint manifold outlet with at least one port 147, and a paint pad holder and paint supply tube, collectively shown as unit 149.

Figure 8:
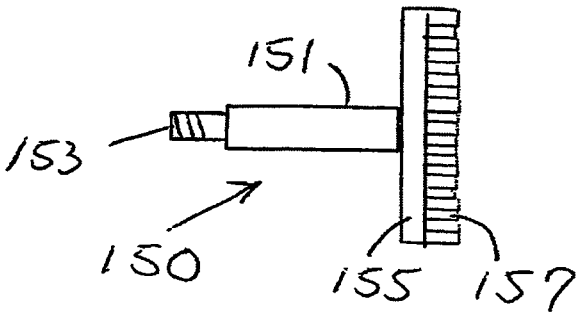
FIG. 8 is a back view of an embodiment of a present invention interchangeable liquid dispenser with interchangeable head and operating mechanism, illustrating an interchangeable brush head unit.

FIG. 8 is a back view of an embodiment of a present invention interchangeable liquid dispenser with interchangeable head and operating mechanism, illustrating an interchangeable brush head unit 150. The interchangeable brush head unit 150 includes a rigid head tube 151 with hosing inside with a threaded end 153 for connection to a universal head connector. In addition, there is a brush support and liquid manifold, collectively shown as unit 155, and a brush 157.

FIG. 9 is a front view of another embodiment of a present invention liquid dispenser with interchangeable head and operating mechanism 201, illustrating a segmented handle member. The liquid dispenser with interchangeable head and operating mechanism 201 includes an elongated handle member 203, a universal head connector 209, and an interchangeable head 211. The elongated handle member 203 includes a handle with controls 205, a removable middle segment 215, and a top segment 213, and a storage compartment 207. The handle with controls 205 includes male connecting means for connection to a female connecting means of the middle segment 215. An upper portion of the middle segment 215 includes male connecting means for connection to a female connecting means of the top segment 213. The male connecting means of the handle with controls 203 is sized and shaped to connect with the female connecting means of the top segment 213. Thus, the length of the elongated handle member may be adjusted.

FIG. 10 is a front view of a universal stopper unit 220 for fitting into different diameter containers. The universal stopper unit includes a large stopper plug 221, a middle stopper plug and a small stopper plug 225, all for providing for a plug fit for different diameter containers in order to transfer liquid into the liquid reservoir. A slideable fluid conduit 227 is used for moving the liquid from a connector fluid conduit 229 having connection to the refill inlet 50 of FIG. 1 on one end and connection to the slideable fluid conduit 227 on the other end. The connector fluid conduit 229 for reservoir refill is sized and shaped to connect to the refill inlet 50 of FIG. 1. Alternatively, custom fit stoppers or covers with dip tubes may be used for filling or refilling the reservoir. One example would be the covers with dip tubes and tubing used for one gallon and five gallon paint cans.

FIG. 11 is a front view of a camelback bag unit for transferring liquid 240 in which the camelback bag unit 240 is the liquid reservoir. The camelback bag unit 240 includes a collapsible bag 241 for holding liquid which has an outlet 245 with connector 247 for connection to fluid conduit extending into the pump unit for dispensing, e.g. pumped through fluid conduit 15 of FIG. 1. In addition, there is a refill port 243 with an easy open cap for transferring liquid from an external source into the camelback bag unit. In this case, there is no refill inlet 50 of FIG. 1, but the storage compartment opens on a side to allow for placement of the bag 241 and the refill port 243.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A liquid dispenser with an interchangeable head and remote operating mechanism which comprises:

a) an elongated handle member having a proximal end for a user to hold and an opposing distal end, said distal end including a storage compartment;

b) a liquid reservoir contained within said storage compartment;

c) said liquid reservoir connected to a universal head connector;

d) said universal head connector having two external exposures at distal end for connection to at least one interchangeable head, and a side inlet with a one way valve, said side inlet will allow liquid to flow into said liquid reservoir and prevent liquid from flowing out of said liquid reservoir;

e) a pump located in said storage compartment connected to said liquid reservoir;

f) remote control means located near said proximal end of said handle member for turning said pump on and off and for operating said pump in a first direction to pump liquid into said liquid supply container and in a second direction for subsequently pumping out of said liquid supply container; and, g) at least one interchangeable head connectable to said universal head connector, selected from the group consisting of a liquid dispensing brush, a liquid dispensing squeegee, a liquid dispensing mop, a paint dispensing head, and combinations thereof.

2. The liquid dispenser with interchangeable head and remote operating mechanism of claim 1 wherein said elongated handle member is a telescopic handle member.

3. The liquid dispenser with interchangeable head and remote operating mechanism of claim 1 wherein said storage compartment further includes a reversible electric motor connected to said pump.

4. The liquid dispenser with interchangeable head and remote operating mechanism of claim 3 wherein said remote control means is connected by wire connection to said electric motor.

5. The liquid dispenser with interchangeable head and remote operating mechanism of claim 3 wherein said remote control means is connected by wireless connection to said electric motor.

6. The liquid dispenser with interchangeable head and remote operating mechanism of claim 3 wherein said electric motor is a battery operated electric motor and said storage compartment includes battery holding means and connection means to at least one of said electric motor, and said remote control means.

7. The liquid dispenser with interchangeable head and remote operating mechanism of claim 1 wherein said at least one interchangeable head is a liquid dispensing mop with a pad.

8. The liquid dispenser with interchangeable head and remote operating mechanism of claim 1 wherein said at least one interchangeable head is a paint dispensing head selected from the group consisting of a paint dispensing pad, a paint dispensing brush and a paint dispensing roller.

9. The liquid dispenser with interchangeable head and remote operating mechanism of claim 1 wherein said at least one interchangeable head is head with a squeegee.

10. The liquid dispenser with interchangeable head and remote operating mechanism of claim 1 wherein said remote control means includes at least one forward pumping control button to a dispenser liquid from said liquid reservoir and at least one reverse pumping control button to feed liquid into said liquid reservoir.

11. A liquid dispenser with an interchangeable head and remote operating mechanism which comprises:

a) an elongated handle member having a proximal end for a user to hold and an opposing distal end, said distal end included a storage compartment;

b) a liquid reservoir contained within said storage compartment;

c) said liquid reservoir connected to a universal head connector;

d) said liquid reservoir having an external fill port inlet with the ability to be filled externally from the storage compartment, this fill means is separate from said universal connector; and, e) said universal head connector located at second end of said liquid reservoir having external exposure at distal end for connection to at least one interchangeable head;

f) a pump located in said storage compartment connected to said liquid reservoir;

g) remote control means located near said proximal end of said handle member for turning said pump on and off and for operating said pump in a first direction to pump liquid into said liquid supply container and in a second direction for subsequently pumping out of said liquid supply container; and, h) at least one interchangeable head connectable to said universal head connector, selected from the group consisting of a liquid dispensing brush, a liquid dispensing squeegee, a liquid dispensing mop, a paint dispensing head, and combinations thereof.

12. The liquid dispenser with interchangeable head and remote operating mechanism of claim 11 wherein said elongated handle member is a telescopic handle member.

13. The liquid dispenser with interchangeable head and remote operating mechanism of claim 11 wherein said storage compartment further includes a reversible electric motor connected to said pump.

14. The liquid dispenser with interchangeable head and remote operating mechanism of claim 13 wherein said remote control means is connected by wire connection to said electric motor.

15. The liquid dispenser with interchangeable head and remote operating mechanism of claim 13 wherein said remote control means is connected by wireless connection to said electric motor.

16. The liquid dispenser with interchangeable head and remote operating mechanism of claim 13 wherein said electric motor is a battery operated electric motor and said storage compartment includes battery holding means and connection means to at least one of said electric motor, and said remote control means.

17. The liquid dispenser with interchangeable head and remote operating mechanism of claim 11 wherein said at least one interchangeable head is a liquid dispensing mop with a pad.

18. The liquid dispenser with interchangeable head and remote operating mechanism of claim 11 wherein said at least one interchangeable head is a paint dispensing head selected from the group consisting of a paint dispensing pad, a paint dispensing brush and a paint dispensing roller.

19. The liquid dispenser with interchangeable head and remote operating mechanism of claim 11 wherein said at least one interchangeable head is a head with a squeegee.

20. The liquid dispenser with interchangeable head and remote operating mechanism of claim 11 wherein said remote control means includes at least one forward pumping control button to dispense liquid from said liquid reservoir and at least one reverse pumping control button to feed liquid into said liquid reservoir.

* * * * *